US005775434A

United States Patent [19]

Sundholm

[11] Patent Number: 5,775,434

[45] Date of Patent: Jul. 7, 1998

[54] FIRE FIGHTING METHOD AND INSTALLATION FOR EXTINGUISHING AN ELONGATED OBJECT

[76] Inventor: Göran Sundholm, Ilmari Kiannon kuja 3, FIN-04310, Tuusula, Finland

[21] Appl. No.: 663,975

[22] Filed: Jun. 14, 1996

[51] Int. Cl.[6] ..... A62C 35/68; A62C 3/10

[52] U.S. Cl. ..... 169/46; 169/62

[58] Field of Search ..... 169/5, 46, 47, 169/54, 62

[56] References Cited

FOREIGN PATENT DOCUMENTS

95/09677 4/1995 WIPO .

*Primary Examiner*—Andrew C. Pike

*Attorney, Agent, or Firm*—Watson Cole Stevens Davis, P.L.L.C.

[57] ABSTRACT

A fire fighting method for extinguishing an elongated object includes spraying a first water-based spray (1*a*) and a second water-based spray (2*a*) with a first spray nozzle (1) and a second spray nozzle (2) to the immediate vicinity of the object in such a way that the first spray is directed towards the underpressure of air generated by the second spray nozzle. To enable efficient extinction with a small number of spray heads without causing high temperature gradients at various points on the surface of the object to be extinguished, the second spray (2*a*) is sprayed towards the underpressure of air generated by the first spray nozzle, and the first and the second spray are sprayed at least approximately in the direction of a longitudinal axis the of the elongated object in such a manner that the sprays are sprayed mainly in opposite directions and that the first and the second spray form a continuous spray path.

14 Claims, 4 Drawing Sheets

FIRE FIGHTING METHOD AND INSTALLATION FOR EXTINGUISHING AN ELONGATED OBJECT

BACKGROUND OF THE INVENTION

The invention relates to a fire fighting method and installation for extinguishing an elongated object. The fire fighting method and installation of the invention are particularly applicable to extinguishing burning turbines for instance in ships and power plants, such as nuclear power plants. The method and installation of the invention are also suitable for extinguishing diesel engines and generators connected to them, for example in power plants and ships. It will be obvious that the invention can also be applied to extinguishing other elongated objects.

It is known that turbine fires are very difficult to extinguish. Turbine fires can be caused, for example, by failure in the lubrication. In most fires, the turbine burns so badly that it will be unfit for use. It is known to extinguish turbines with Halon or carbon dioxide gases. Recent development has introduced water fog extinction into the market to replace gas extinction. A plurality of spray heads (typically at least ten) mounted at a distance from the turbine case are used in the fire fighting. The water fog nozzles are directed radially and perpendicularly towards the turbine case.

A difficult problem in water fog extinction is that the sprays cool the turbine case so efficiently and unevenly that it becomes distorted because of thermal stresses. Attempts have been made to solve this problem by cooling the turbine case discontinuously in such a way that the extinguishing medium is sprayed at certain intervals. Despite discontinuous extinction, the sprays of extinguishing medium have cooled the turbine down so unevenly that expensive components of the turbine have been distorted and damaged, e.g., as a result of abrasion. It could be possible to provide more even cooling if a very large number of spray nozzles were arranged around the entire turbine; however such an arrangement would not only be expensive but it might also be impossible to realize in some cases, since it takes up a lot of space.

Slow cooling is not even desirable in fire fighting, since it allows the fire to overheat the turbine and damage it badly.

Another problem is the use of toxic media in fire fighting. In view of environmental aspects, the aim should naturally be to avoid the use of toxic substances in fire fighting.

When other elongated objects, such as diesel engines connected to, e.g., a generator, are extinguished, the problem is that fire fighting has not been sufficiently efficient and rapid. Further problems have been the need for a large number of spray heads and the use of toxic substances.

International Publication No. WO 95/09677 discloses a method for fighting fire in narrow spaces. The method employs spray nozzles arranged one after the other to spray fog sprays so that they intensify one another. This has been implemented in such a way that the spray from the first spray nozzle is directed towards the spray from the second spray nozzle, and the spray from the second spray nozzle is directed towards the spray from the third spray nozzle. The sprays are sprayed in a bilge room around the lower end of a diesel engine so that they form a circle surrounding the lower end of the diesel engine. This provides a flow which cools the lower end of the diesel engine efficiently.

To make the extinguishing medium surround the diesel engine along its entire length, liquid sprays are also sprayed both from the upper end of the diesel engine and from below.

This known method provides a significant improvement to the art known before WO 95/09677.

SUMMARY OF THE INVENTION

The object of the present invention is to provide such a new fire fighting method for extinguishing turbines and other elongated objects that is essentially more efficient than the prior art methods, although a smaller number of spray heads are used. To achieve this, the present invention provides a new fire fighting method comprising spraying at least a first water-based spray and a second water-based spray with a first spray nozzle and a second spray nozzle to the immediate vicinity of the object, the first spray being sprayed from, the first spray nozzle, and the second spray being sprayed from the second spray nozzle in such a way that underpressure of air is formed in the immediate vicinity of the first spray nozzle and in the immediate vicinity of the second spray nozzle, the first spray being sprayed towards the underpressure of air generated by the second spray nozzle, whereby

- the second spray is sprayed towards the underpressure of air generated by the first spray nozzle, and
- the first and the second spray are sprayed at least approximately in the direction of the longitudinal axis X—X of the elongated object in such a manner that the sprays are sprayed mainly in opposite directions in the longitudinal direction of the elongated object and that the first and the second spray form a continuous spray path so that, when viewed from each end of the object, there are continuous flows extending at least substantially along the entire length of the elongated object in opposite directions.

The invention is based on the surprising discovery that even sprays that are sprayed towards each other can intensify each other when their drop size is small: one spray can reverse another one if the drop size is sufficiently small. In practice, water sprays contain drops of different sizes. When the present invention is applied, the biggest drops fall down because of gravity, and smaller drops—which are the most efficient in view of extinction and cooling—continue along the spray path and are capable of turning according to the positions of the spray nozzles.

According to a preferred embodiment, the first spray is sprayed from a point which, in relation to the elongated object, is diametrically substantially opposite to the point from which the second spray is sprayed.

According to another preferred embodiment, a third water-based spray is sprayed to the immediate vicinity of the object with a third spray nozzle, and a fourth water-based spray is sprayed to the immediate vicinity of the object with a fourth spray nozzle in such a manner that underpressure of air is formed in the immediate vicinity of the third spray nozzle and in the immediate vicinity of the fourth spray nozzle, whereby the third spray is substantially parallel to the first spray, and the fourth spray is substantially parallel to the second spray in such a manner that, in addition to the first spray, the third spray is sprayed towards the underpressures of air generated by the second and the fourth spray nozzle, and that, in addition to the second spray, the fourth spray i s sprayed towards the underpressures of air generated by the first and the third spray nozzle so that, when viewed from each end of the irongated object, there are continuous flows flowing in opposite directions and being diametrically opposite to each other in relation to the elongated object, the flows extending at least substantially along the entire length of the elongated object.

Yet another analogous embodiment comprises spraying at least a first water-based spray and a second water-based spray with a first spray nozzle and a second spray nozzle to the immediate vicinity of the object, the first spray being sprayed from the first spray nozzle, and the second spray being sprayed from the second spray nozzle in such a way that underpressure of air is formed in the immediate vicinity of the first spray nozzle and in the immediate vicinity of the second spray nozzle, the first spray being sprayed towards the underpressure of air generated by the second spray nozzle, whereby the second spray is sprayed towards the underpressure of air generated by the first spray nozzle and the first and the second spray are sprayed at least approximately in the direction of the longitudinal axis of the elongated object in such a manner that the sprays are sprayed mainly in opposite directions in the longitudinal direction of the elongated object, whereby a first further spray and a second further spray are sprayed with at least two further spray nozzles, mounted between the first and the second spray nozzles, diametrically opposite to each other in relation to the elongated object, in such a manner that underpressure of air is generated in the immediate vicinity of the first further spray nozzle and in the immediate vicinity of the second further spray nozzle, and that the first further spray is sprayed towards the underpressure of air generated by the second spray nozzle, and the second further spray is sprayed towards the underpressure of air generated by the first spray nozzle, whereby the first and the second spray with the further sprays form a continuous spray path in such a manner that, when viewed from each end of the elongated object, there are continuous flows extending at least substantially along the entire length of the elongated object in opposite directions.

To render the last-mentioned method extremely efficient and/or particularly applicable to fighting great fires, a method is employed wherein, in addition to the first and second spray nozzle, a third water-based spray and a fourth water-based spray are sprayed with a third spray nozzle and a fourth spray nozzle to the immediate vicinity of the object in such a manner that underpressure of air is generated in the immediate vicinity of the third spray nozzle and in the immediate vicinity of the fourth spray nozzle, whereby the third spray nozzle sprays towards the underpressures of air of the second and fourth spray nozzle, and the fourth spray nozzle sprays towards the underpressures of air of the first and third spray nozzle.

The most significant advantages of the method of the invention are that it allows elongated objects to be extinguished very efficiently with a small number of spray heads. As compared with the prior art, the extinguishing time is shortened to a third, and the number of spray heads is reduced to less than a half, even to a fifth. In addition, the fire fighting does not subject various parts of the object to high temperature gradients, which in certain applications, such as fighting turbine fires, could cause the turbine to be completely destroyed in the fire. Furthermore, it is not necessary to use environmentally detrimental substances for fire fighting, since the extinguishing medium is typically pure water, to which it is however possible to add small amounts of additives.

Another object of the present invention is to provide such a new fire fighting installation for extinguishing turbines and other elongated objects that is essentially more efficient than the prior art methods although a smaller number of spray heads are used. To achieve this, the present invention provides a new fire fighting installation for extinguishing an elongated object, the installation comprising a first spray nozzle and a second spray nozzle, said nozzles being of a type producing water fog in such a way that under-pressure of air is generated in the immediate vicinity of the spray nozzles, the first spray nozzle being directed towards the second spray nozzle, and the second spray nozzle being directed towards the first spray nozzle, and both the first and the second spray nozzles being directed at least substantially in the longitudinal direction of the elongated object to form a continuous spray path so that, when viewed from each end of the object, there are flows extending at least substantially along the entire length of the elongated object in opposite directions.

The most significant advantages of the fire fighting installation of the invention are that it allows elongated objects to be extinguished very efficiently and evenly with a very small number of spray heads and without the use of environmentally detrimental extinguishing media.

The invention is particularly applicable to fire fighting in closed spaces, but it can also be successfully applied to fire fighting in partly or completely open spaces.

BRIEF DESCRIPTION OF THE DRAWINGS

In the following, the invention will be described in greater detail with reference to the accompany drawings, in which.

DETAILED DESCRIPTION OF THE PREFERRED EMBODIMENTS

Figure 1:
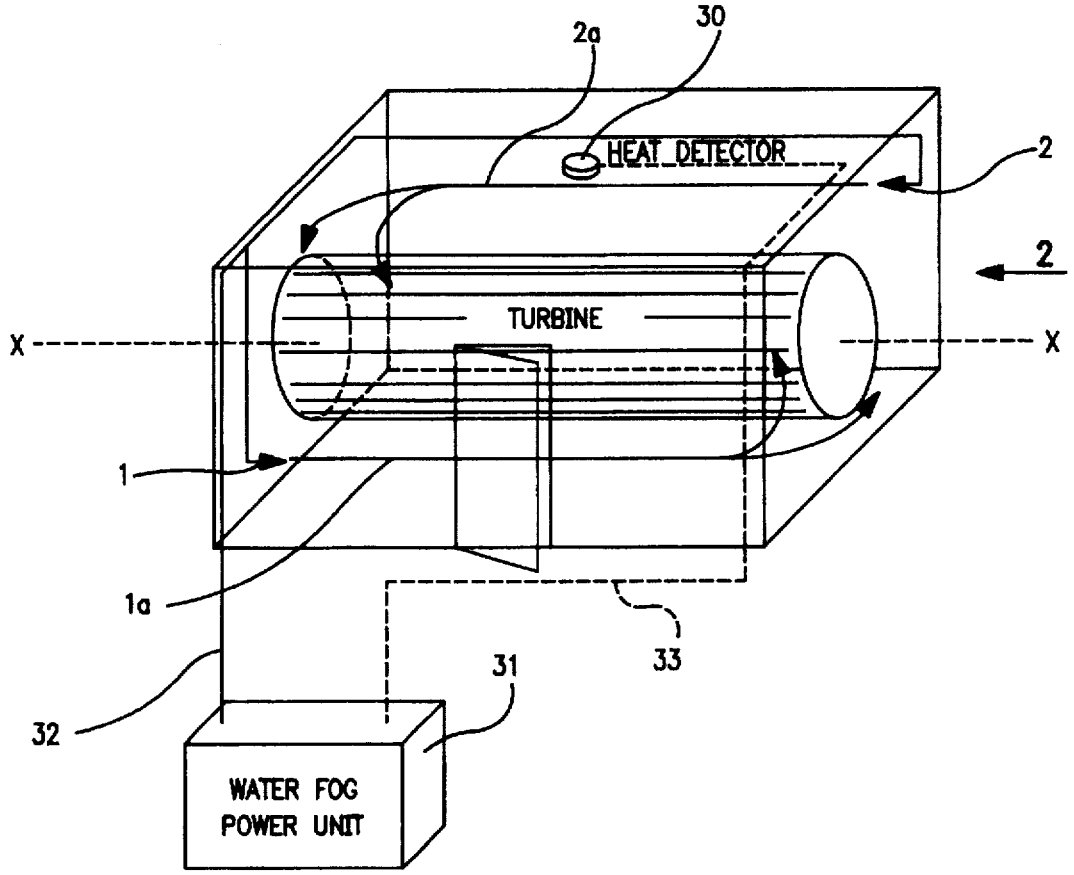
FIG. 1 shows a first embodiment of the invention for extinguishing a turbine in a substantially closed space.

FIG. 1 shows an arrangement for fighting a possible fire in a turbine. The turbine is located in a space, such as a 130 $m^3$ room. The space is closed, but it may also be open because there is a door to the space. In the figure, the door is ajar.

In the following, the same reference numeral is used for spray heads and their nozzles: the nozzle of spray head 1 is also indicated by reference numeral 1, the nozzle of the spray head 2 is also indicated by reference numeral 2, etc.

The essential components of the arrangement of FIG. 1 are a fire detector 30, a first spray head 1 close to a first end of the turbine, a second spray head 2 close to a second end of the turbine, a power unit 31, and lines 32 for supplying a water-based extinguishing medium to spray heads 1, 2. The fire detector 30 is connected to the power unit 31. The room shown in FIG. 1 is about 130 $m^3$.

In principle, the fire detector 30 may be any known fire detector, typically a heat detector, which reacts to a rise in temperature and gives a signal to the power unit 31 when the temperature has exceeded a certain limit value. Alternatively, it may be a smoke detector or a detector that reacts to liquid flow.

The spray nozzles 1, 2 are of a very modern type and spray small water-based drops, mainly a medium resembling water fog. When spraying the water fog, the spray heads 1, 2 and their nozzles generate underpressure of air in their immediate vicinity. Such spray heads are disclosed, for example, in International Patent Application Publication No. WO 92/20453. The spray heads typically comprise a plurality of nozzles whose sprays are pulled together to form one strong spray with a high moment and a long range when the spraying pressure is sufficiently high. As distinct from FIG. 1, it is also possible to mount the spray nozzles 1, 2 further away from the ends of the turbine so that they spray the turbine efficiently even at its ends.

Figure 2:
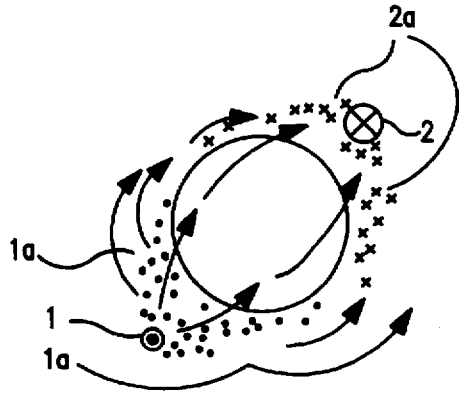
FIG. 2 shows a view in the direction of arrow 2 in FIG. 1.

The spray heads 1 and 2 are arranged to spray along the longitudinal axis X—X of the turbine in opposite directions, whereby the spray heads, in relation to the turbine, are located diametrically opposite to each other as can be seen clearly from FIG. 2. When the spray heads are arranged in this way with respect to the turbine, they can produce a flow which circles the turbine fairly evenly. If the turbine is very long, it is possible to provide two further spray nozzles in further spray heads between the spray nozzles 1 and 2 at the ends of the turbine, i.e., between the ends of the turbine. Such further spray nozzles (not shown in FIG. 1) are preferably mounted in such a way that the first one is aligned with spray nozzle 1 and sprays in substantially the same direction as spray nozzle 1, whereas the second spray nozzle is aligned with spray nozzle 2 and sprays in substantially the same direction as spray nozzle 2.

The power unit 31 is of such a type that it can supply a water-based extinguishing medium, preferably water, at a high pressure to the spray heads 1, 2. The pressure generated by the power unit 31 is preferably 20 to 300 bar, more preferably 40 to 150 bar. The power unit 31 can comprise hydraulic accumulators and/or a high-pressure pump. In FIG. 1, the heat detector 30 is connected to the power unit 31 by a line 33, through which it gives a signal to the power unit 31. Having received the signal, the power unit 31 is arranged to supply the extinguishing medium to the spray heads 1, 2.

Figure 8:
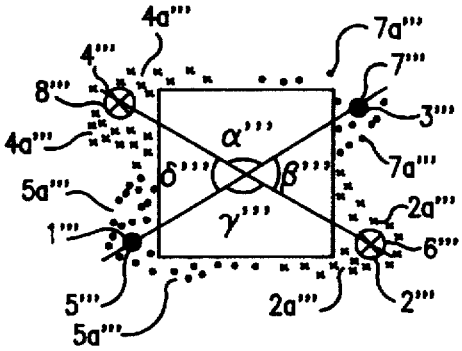
FIG. 8 shows a view in the direction of arrow 8 in FIG. 7.

FIGS. 2 and 1 illustrate the flow that is produced around the turbine. In FIG. 2 (and FIGS. 4, 6, and 8), crosses represent inward sprays perpendicular to the plane of the paper, and points represent sprays in the opposite direction. When spray 1*a* from spray head 1 comes near the end of the turbine where spray head 2 is located, it is sucked to the underpressure of air in the immediate vicinity of spray head 2 and therefore changes its original direction. Spray head 2 thus sucks the spray towards it, gives it more speed, and guides it so that it becomes parallel to spray 2*a* from spray head 2. Spray head 2 thus reverses spray 1*a* at the end of the turbine. Correspondingly, spray 2*a* from spray head 2 and the first spray carried with it are supplied towards spray head 1, and the, spray turns at spray head 1, see the arrows in FIG. 1.

Figure 3:
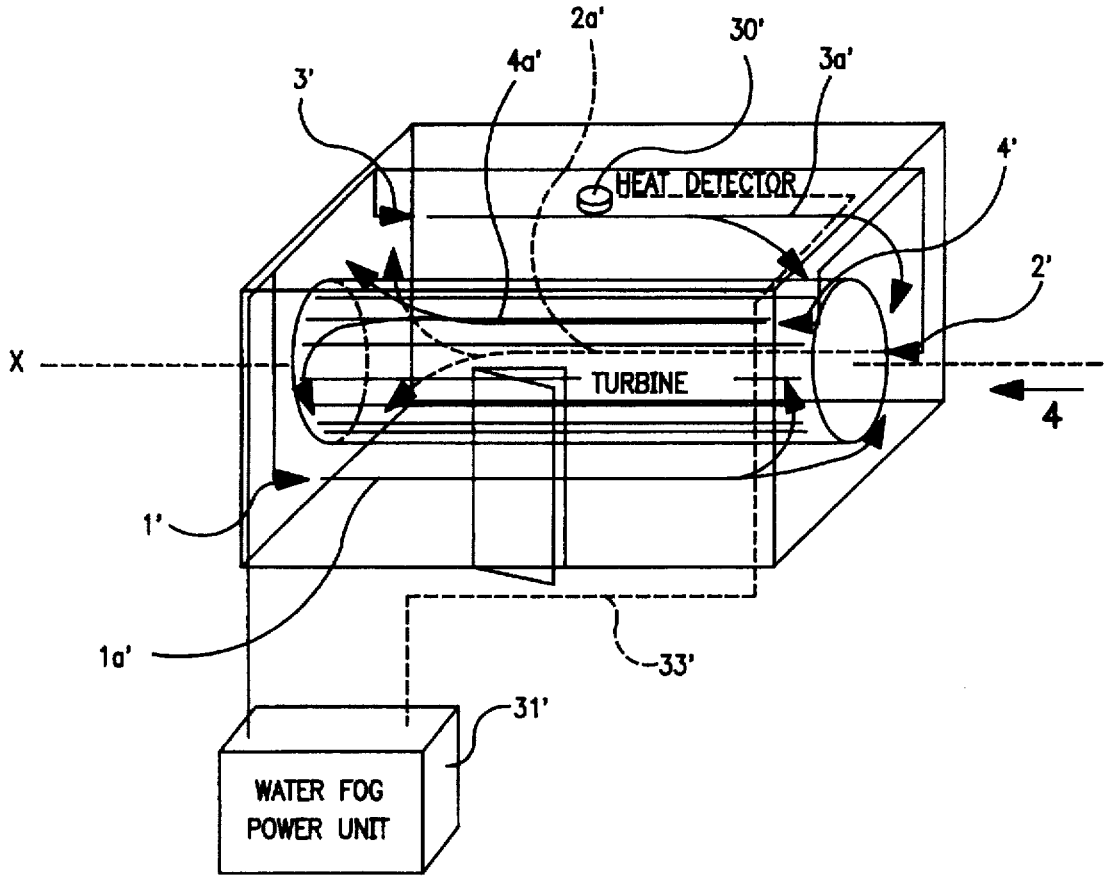
FIG. 3 shows a second embodiment of the invention for extinguishing a turbine in a substantially closed space.

FIG. 3 shows a second embodiment of the invention, which is particularly suitable for use in larger spaces than the embodiment of FIG. 1 ,i.e., a 260 $m^3$ room. In FIG. 3, similar reference numerals have the same significance as in FIG. 1 i.e., 30' is a heat detector, 31' is a power unit and 33' is a line connecting the heat detector 30' to the power unit 31'. As compared with the embodiment shown in FIG. 1, the difference is that spray heads 3' and 4' are used in addition, whereby spray heads 1' and 3' are provided on diametrically opposite sides of the turbine at the first end thereof and are arranged to spray parallelly (in the longitudinal direction of the turbine), and spray heads 2' and 4' are provided on diametrically opposite sides of the turbine at the second end thereof and are arranged to spray parallelly (in the longitudinal direction of the turbine) in the opposite direction to spray heads 1' and 3'.

Figure 4:
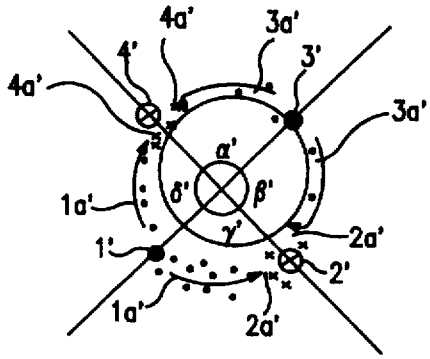
FIG. 4 shows a view in the direction of arrow 4 in FIG. 3.

From FIG. 4, which shows a view in the direction of arrow 4 in FIG. 3, it can be seen that spray heads 1', 2', 3' and 4' are at angles α', β', γ', δ' with respect to each other. The angles α', β', γ', δ' are each about 90°. This arrangement allows sprays 1*a*', 2*a*', 3*a*' and 4*a*' to form two continuous flows which, in relation to the turbine, are diametrically opposite to each other and flow in opposite directions. Extinction tests corresponding to the arrangement of FIG. 4 have been performed in a room of about 260 $m^3$ with excellent results. The angles α', β', γ', δ' may differ from what is disclosed, but to ensure even extinction and cooling of the turbine, no angle should preferably be greater than 120° or smaller than 50°.

Figure 5:
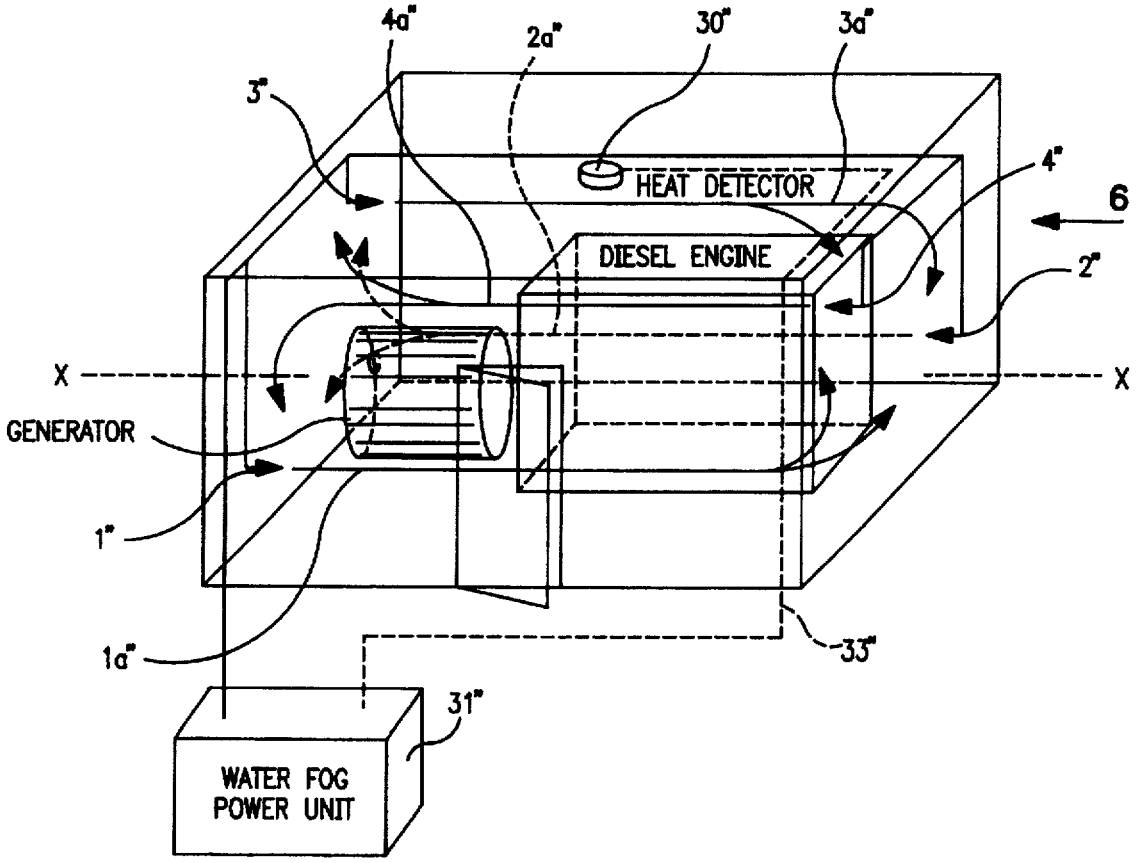
FIG. 5 shows an embodiment corresponding to the second embodiment of the invention for extinguishing a diesel engine and a generator connected to it in a substantially closed space.

FIG. 5 shows an arrangement corresponding to the one shown in FIG. 3 in a 260 $m^3$ room except that, instead of a turbine, it involves a diesel engine and a generator connected to it. The spray heads 1", 2", 3" and 4" are arranged as in FIG. 3.

Figure 6:
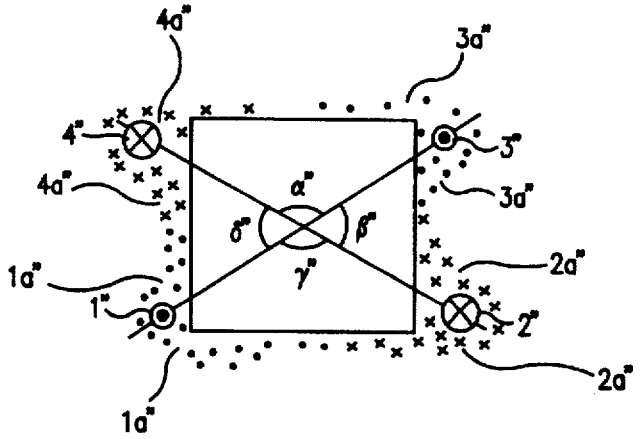
FIG. 6 shows a view in the direction of arrow 6 in FIG. 5.

FIG. 6 shows a view in the direction of arrow 6 in FIG. 5.

In FIGS. 5 and 6, similar reference numerals have the same significance as in FIG. 3, i.e., 30' is a heat detector, 31' is a power unit and 33' is a line connecting the heat detector 30' to the power unit 31', and 1*a*", 2*a*", 3*a*", and 4*a*" are sprays from spray heads 1", 2", 3", and 4". It can be seen that angles α" and γ" are about 110°, and angles β" and δ" are about 70°.

Figure 7:
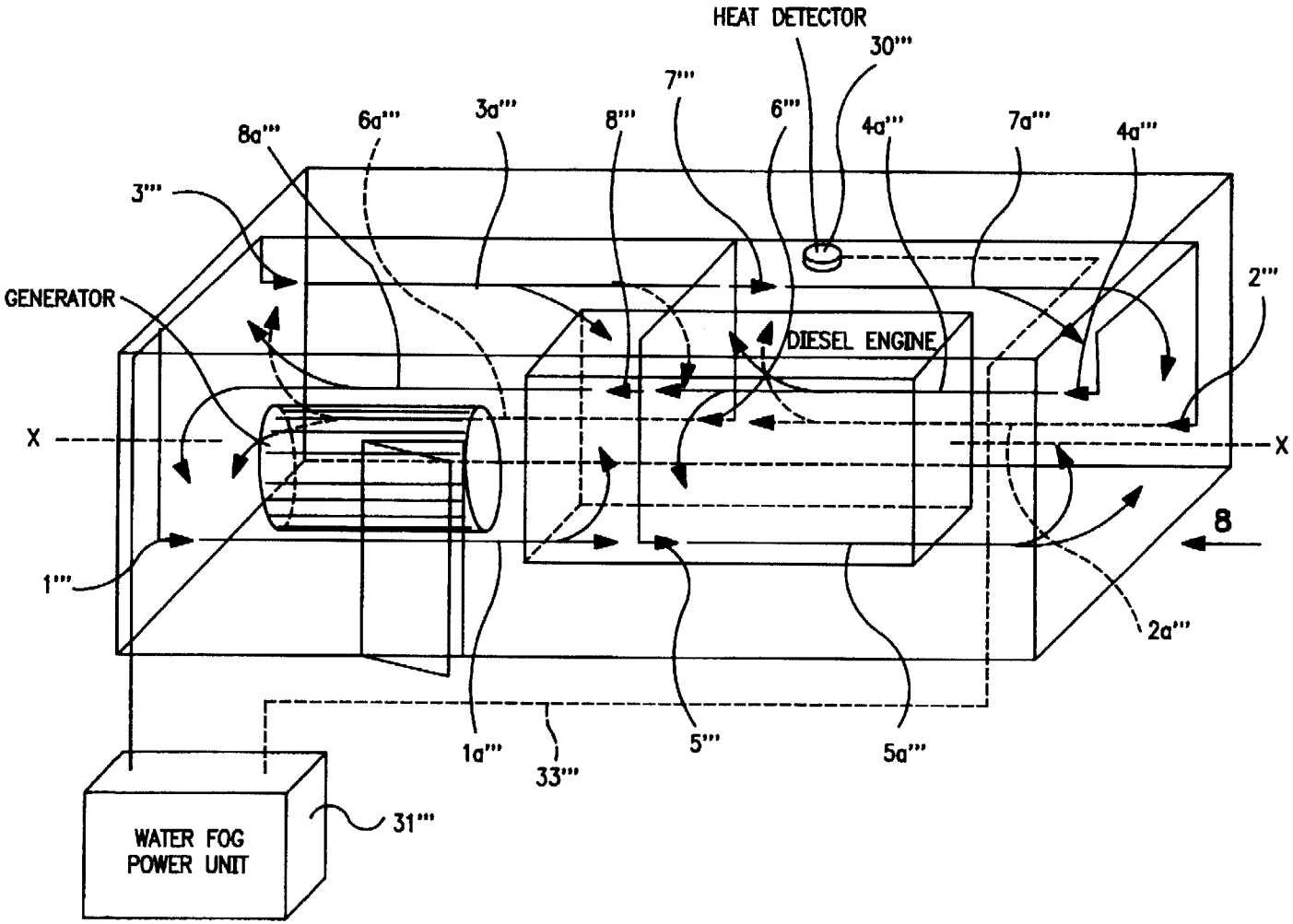
FIG. 7 shows a third embodiment of the invention for extinguishing a diesel engine and a generator connected to it in a substantially closed space.

FIG. 7 shows a third embodiment of the invention for extinguishing a large diesel engine and a generator connected to it in a 520 $m^3$ room. The arrangement corresponds to the one of FIG. 5 except that further spray heads 5'", 6'", 7'", 8'" with nozzles are provided between the spray heads 1'", 3'" and 2'", 4'" at the ends.

The further spray nozzles 5'", 6'", 7'", 8'" are mounted approximately midway between the spray nozzles at the ends in such a way that further spray nozzle 5' is substantially parallel to spray nozzle 1'" and in alignment with it, further spray nozzle 6'" is substantially parallel to spray nozzle 2'" and in alignment with it, further spray nozzle 7'" is 25 substantially parallel to spray nozzle 3'" and in alignment with it, and further spray nozzle 8'" is substantially parallel to spray nozzle 4'" and in alignment with it. When projected on the same plane, the further spray nozzles are offset by 50° to 120° from one another, i.e. angles α'", β'", γ'", δ'" are within the given range (see FIG. 8, which shows a view in the direction of arrow D in FIG. 7). Spray heads 5'", 6'", 7'" and 8'" emit respective sprays 52'", 6*a*'", 7*a*'" and 8*a*'", and 30'" is a heat detector, 31'" is a power unit, and 33'" is a line connecting the heat detector 30'" to the power unit 31'".

In FIG. 9, the purpose of the further spray nozzles 5'", 6'", 7'" and 8'" is to intensify the 35 sprays in the following way: further spray nozzle 5'" intensifies spray 1*a*'", supplied from behind, and sprays 2*a*'" and 4*a*'", supplied towards it; further spray nozzle 6'" intensifies spray 2*a*'" supplied from behind, and sprays 1*a*'" and 3*a*'", supplied towards it; further spray nozzle 7'" intensifies spray 3*a*'" supplied from behind, and sprays 2a'" and 4a'", supplied towards it; and further spray nozzle 8'" intensifies spray 4a'", supplied from behind, and sprays 1a'" and 3a'", supplied towards it. If the distance between the spray nozzles 1'" and 3'" is very long, it is conceivable in the example of FIG. 8 that a further spray nozzle (not shown in FIG. 8) is mounted between spray nozzles 1 '" and 3'" to ensure a continuous flow across the ends of the object. In this case, a corresponding further spray nozzle (not shown in FIG. 8) would be mounted between spray nozzles 2'" and 4'".

In the above, the invention has been described by means of examples, and therefore it is pointed out that the invention can be implemented in many ways within the scope of the appended claims. It will therefore be clear that, for example, the number of nozzles in the spray heads can vary. The fire fighting method and installation of the invention can be successfully employed in the spaces of FIGS. 1, 3, 5, and 7 even if the door is open during the fire. The invention can also be applied to completely open spaces.

I claim:

1. A fire fighting method for extinguishing a fire in an elongated object having a longitudinal axis, an entire length, and ends said method comprising:

spraying to an immediate vicinity of the object a first extinguishing medium spray with a first spray nozzle in at least approximately a first direction of the longitudinal axis, said first extinguishing medium spray generating and underpressure of air in an immediate vicinity of the first spray nozzle, spraying to an immediate vicinity of the object a second extinguishing medium spray with a second spray nozzle in at least approximately a second direction of the longitudinal axis opposite said first direction, said second extinguishing medium spray generating an underpressure of air in an immediate vicinity of the second spray nozzle, said first and second extinguishing medium sprays providing a continuous flow of extinguishing medium around t he elongated object.

2. The method of claim 1, wherein the first spray (1a) is sprayed from a point which, in relation to the elongated object, is diametrically substantially opposite to a point from which the second spray (2a) is sprayed.

3. The method of claim 1 or 2, wherein the first and the second sprays are sprayed from respective points located close to the respective ends of the elongated object.

4. The method of claim 1, wherein the elongated object is a turbine.

5. The method of claim 1, wherein the elongated object is a diesel engine.

6. A fire fighting method for extinguishing a fire in an elongated object having a longitudinal axis, an entire length, and ends, said method comprising:

spraying to an immediate vicinity of the object a first water-based spray (1a') with a first spray nozzle (1'), a second water-based spray (2a')with a second spray nozzle (2'), a third water-based spray (3a') with a third spray nozzle (3'), and a fourth water-base spray (4a') with a fourth spray nozzle (4');

generating by said spraying underpressures of air in an immediate vicinity of the first spray nozzle, in an immediate vicinity of the second spray nozzle, in an immediate vicinity of the third spray nozzle, and in an immediate vicinity of the fourth spray nozzle;

directing the first spray at least approximately in a first direction of the longitudinal axis and with the third spray towards the underpressures of air generated by the second and fourth spray nozzles;

directing the second spray at least approximately in a second direction of the longitudinal axis and with the fourth spray towards the underpressures of air generated by the first and third spray nozzles, the first and second directions being opposite directions;

directing the third spray substantially parallel to the first spray and with the first spray towards the underpressures of air generated by the second and fourth spray nozzles;

directing the fourth spray substantially parallel to the second spray and with the second spray towards the underpressures of air generated by the first and third spray nozzles; and forming continuous flows in the opposite directions with the first, second, third, and fourth sprays, diametrically opposite to each other in relation to the elongated object, having continuous spray paths extending at least substantially along the entire length of the elongated object in the opposite directions.

7. The method of claim 6, wherein said directing the first spray (1a'), the second spray (2a'), the third spray (3a'), and the fourth spray (4a') further comprise directing the sprays from points which are circumferentially offset about the longitudinal axis in relation to one another by 50° to 120°.

8. The method of claims 6 or 7, wherein said directing the first spray and the second spray further comprise directing the first spray and the second spray from points located close to the ends of the elongated object.

9. The method of claim 6, wherein the elongated object is a turbine, and said forming further comprises forming the continuous flows along the turbine.

10. The method of claim 6, wherein the elongated object is a diesel engine, and said forming further comprises forming the continuous flows along the diesel engine.

11. A fire fighting method for extinguishing a fire in an elongated object having a longitudinal axis, an entire length, and ends, said method comprising:

spraying to an immediate vicinity of the object at least a first water-based main spray (1a'") with a first main spray nozzle (1'"), a second water-based main spray (2a'") with a second main spray nozzle (2'"), a first further spray (5a'") with a first further spray nozzle (5'"), and a second further spray (6a'") with a second further spray nozzle (6'"), wherein the first and second further spray nozzles are mounted between the first and second main spray nozzles diametrically opposite to each other in relation to the elongated object;

generating by said spraying underpressures of air in an immediate vicinity of the first main spray nozzle, in an immediate vicinity of the second main spray nozzle, in an immediate vicinity of the first further spray nozzle, and in an immediate vicinity of the second further spray nozzle;

directing the first main spray at least approximately in a first direction of the longitudinal axis towards the underpressure of air generated by the second main spray nozzle;

directing the second main spray at least approximately in a second direction of the longitudinal axis towards the underpressure of air generated by the first main spray nozzle, the first and second directions being opposite directions;

directing the first further spray towards the underpressure of air generated by the second main spray nozzle;

directing the second further spray towards the underpressure of air generated by the first main spray nozzle; and forming continuous flows in the opposite directions with the first and second main sprays and with the first and second further sprays having a continuous spray path extending at least substantially along the entire length of the elongated object in the opposite directions.

12. The method of claim 11, wherein:

said spraying further comprises spraying to the immediate vicinity of the object a third water-based main spray (3*a*'") with a third main spray nozzle (3'") and a fourth water-based main spray (4*a*'") with a fourth main spray nozzle (4'");

said Generating further comprises generating by said spraying the third and fourth main sprays underpressures of air in an immediate vicinity of the third main spray nozzle and in an immediate vicinity of the fourth main spray nozzle; and said method further comprises directing the third main spray towards the underpressures of air generated by the second and fourth main spray nozzles, and directing the fourth spray towards the underpressures of air generated by the first and third main spray nozzles.

13. The method of claim 12, wherein:

said directing the first main spray, the second main spray, the third main spray, and the fourth main spray further comprise directing the first and third main sprays from main points located close to one end of the ends of the elongated object, and directing the second and fourth main sprays from main points located close to another, opposite end of the ends of the elongated object, the main points being circumferentially offset about the longitudinal axis from one another by 50° to 120°;

said spraying further comprises spraying to the immediate vicinity of the object a third further spray (7*a*'") with a third further spray nozzle (7'") and a fourth further spray (8*a*'") with a fourth further spray nozzle (8'"); and said method further comprises directing the first further spray, the second further spray, the third further spray, and the fourth further spray from further points which are circumferentially offset about the longitudinal axis from one another by 50° to 120°.

14. The method of claim 13, wherein the further points are substantially aligned with the main points.

* * * * *